US007673468B2

(12) United States Patent
Bhatti et al.

(10) Patent No.: US 7,673,468 B2
(45) Date of Patent: Mar. 9, 2010

(54) HIGH EFFICIENCY EVAPORATIVELY COOLED CONDENSER

(75) Inventors: Mohinder Singh Bhatti, Amherst, NY (US); Ilya Reyzin, Williamsville, NY (US); Shrikant Mukund Joshi, Williamsville, NY (US)

(73) Assignee: Delphi Technologies, Inc., Troy, MI (US)

( * ) Notice: Subject to any disclaimer, the term of this patent is extended or adjusted under 35 U.S.C. 154(b) by 476 days.

(21) Appl. No.: 11/526,981

(22) Filed: Sep. 26, 2006

(65) Prior Publication Data

US 2008/0072614 A1 Mar. 27, 2008

(51) Int. Cl.
*F28C 1/00* (2006.01)
*F28D 5/00* (2006.01)

(52) U.S. Cl. ..... 62/315; 62/316

(58) Field of Classification Search ..... 62/171, 62/305, 307, 386, 399, 94, 121, 271, 315, 62/316, 498; 165/149, 153, 166; 228/183; 261/99, 104, 107, 113, 114.5, 119.1, 140.2, 261/154; 429/26

See application file for complete search history.

(56) References Cited

U.S. PATENT DOCUMENTS 2,162,152 A * 6/1939 Wulle ..... 165/60
2,218,407 A * 10/1940 Meyerhocfer ..... 62/307
3,922,880 A * 12/1975 Morris ..... 62/498
3,984,995 A 10/1976 Starr et al. ..... 62/305
4,566,290 A * 1/1986 Otterbein ..... 62/304
4,774,266 A * 9/1988 Boudakian et al. ..... 521/90
5,034,162 A * 7/1991 Chiu ..... 261/24
5,186,242 A 2/1993 Adachi et al. ..... 165/110
6,065,299 A 5/2000 Chen ..... 62/277
6,179,050 B1 * 1/2001 Dey et al. ..... 165/149
6,354,101 B1 * 3/2002 Levitin et al. ..... 62/305
6,854,278 B2 * 2/2005 Maisotsenko et al. ..... 62/94

FOREIGN PATENT DOCUMENTS

EP 1528345 A1 5/2005

* cited by examiner

*Primary Examiner*—Frantz F Jules
*Assistant Examiner*—Emmanuel Duke
(74) *Attorney, Agent, or Firm*—Patrick M. Griffin

(57) ABSTRACT

A heat exchanger having a plurality of tubes that define refrigerant passages extending vertically from a lower end to an upper end. A bottom header is in fluid communication with the passage at the lower end of the tube, and a top header is in fluid communication with the passage at the upper end of the tube. A plurality of plates extends rearwardly from the tubes to a distal edge. Adjacent plates extending from adjacent tubes are closed off at the distal edges by a connector, and adjacent plates extending from the same tube have a rear opening between the distal edges for receiving air into the assembly. A plurality of orifices is disposed along the plates to allow air from the rear opening to flow downstream between the tubes. A water tank and wicking material are provided for wetting the plates.

5 Claims, 6 Drawing Sheets

HIGH EFFICIENCY EVAPORATIVELY COOLED CONDENSER

BACKGROUND OF THE INVENTION

1. Field of the Invention

The subject invention relates to conditioning air and, more specifically, to conditioning air more efficiently using the principles of evaporative cooling.

2. Description of the Prior Art

It is known to cool air by flowing the air over an evaporator comprising a set of tubes carrying a refrigerant. The heat is transferred from the air to the refrigerant to cool the air. The refrigerant then passes through a compressor and is compressed into a superheated vapor. The heat must be rejected out of the refrigerant before it can be used to cool additional air. Typically, the heat is rejected into the atmosphere by transferring to ambient air flowing over a condenser comprising a set of tubes carrying the superheated refrigerant vapor. As the refrigerant cools, it condenses back into a liquid. These tubes are referred to as condensing tubes. However, since this system requires energy, continuing attempts have been made to increase the cooling efficiency and reduce the energy required. One such example is found in U.S. Pat. No. 6,354,101 to Levitin et al., which teaches evaporating water from a series of rods upstream of a condenser. When the air passes over the rods, heat is transferred to the water, causing it to evaporate and thereby reducing the temperature of the airstream. The air entering the condenser is cooler and therefore able to receive more heat from the superheated refrigerant, which reduces the energy consumption of the air conditioner. However, the assembly of Levitin is bulky and requires the use of extra components, such as the rods.

SUMMARY OF THE INVENTION AND ADVANTAGES

The invention provides a tube defining a refrigerant passage extending longitudinally from a lower end to an upper end, with a bottom header in fluidic communication with the passage at the lower end of the tube, and a top header in fluidic communication with the passage at the upper end of the tube. A plate extends longitudinally from a lower end to an upper end and projects outwardly from the tube to a distal edge, and a supply of water is provided for wetting the plate. The water evaporates from the plate and cools air moving over the plate.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
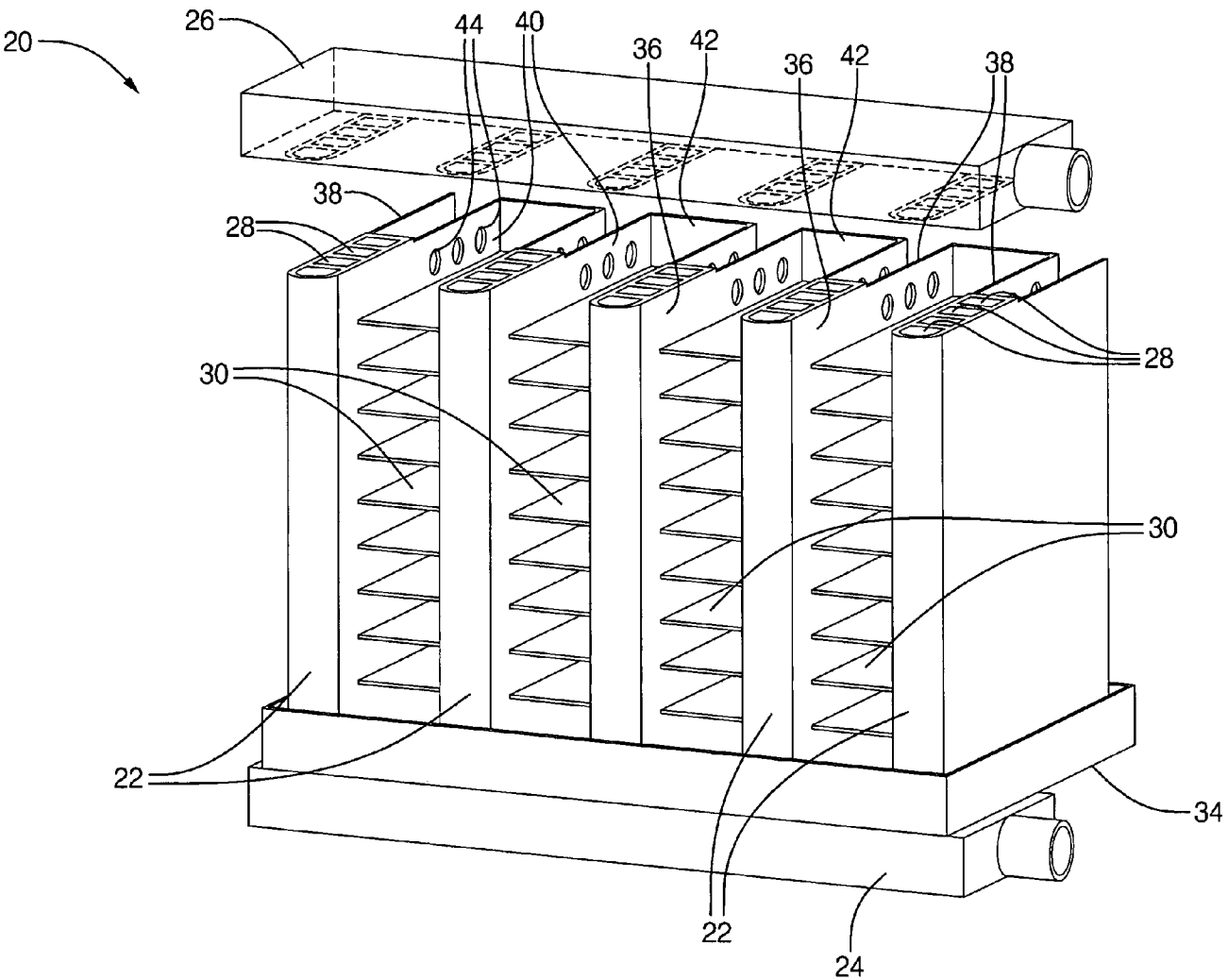
FIG. 1 is a front perspective view of a heat exchanger in accordance with a first embodiment of the present invention.

Referring to the Figures, wherein like numerals indicate corresponding parts throughout the several views, a condenser assembly 20 for an air conditioning system is shown generally. The assembly 20 includes a plurality of tubes 22 spaced apart from each other. The tubes 22 extend in a vertical direction from a lower end to an upper end between a bottom header 24 and a top header 26. A plurality of dividers 28 extend vertically within each of the tubes 22 to provide a plurality of refrigerant passages. The tubes 22 have parallel sides extending horizontally between a rounded front and a closed back. A plurality of fins 30 extend horizontally between adjacent tubes 22 from the front to the back and define a downstream section for receiving air between the adjacent tubes 22. A blower 32 is provided to move air through the assembly 20, as is well known in the art. A water tank 34 is provided to define a supply of water for wetting the tubes 22. The water tank 34 surrounds the lower ends of the tubes 22, and a tube-side wicking material 36 extends upwardly from the water tank 34 on the outside of the tubes 22. Water moves through the wicking material by capillary action into the downstream section. Although the water tank 34 is shown around the lower ends of the tubes 22, it could also be placed around the upper ends to allow gravity to assist the wicking action. Additionally, two water tanks 34 could be used around the lower and upper ends of the tubes 22.

A plurality of plates 38 each extend rearwardly from each of the parallel sides of each tube to a distal edge. Adjacent plates 38 extending from the same tube define an upstream section, and a rear opening is formed between the distal edges of these plates 38. Air provided by the blower 32 is received in the upstream section via the rear opening. The water tank 34 also surrounds the lower ends of the plates 38 about the upstream section, and a plate-side wicking material 40 extends upwardly from the water tank 34 to line, i.e. cover, the plate. Water is therefore introduced to the upstream section by capillary action similar to the water in the downstream section.

A midstream section is defined between adjacent plates 38 extending from adjacent tubes 22. The midstream section is closed off at the back by a connector 42 that extends vertically to connect the distal edges of these plates 38. Therefore, the midstream section is aligned with and in fluid communication with the downstream section. The plates 38 include a plurality of orifices 44 to allow air to flow from the upstream section into the midstream section. The fins 30 extend rearwardly from the downstream section to extend between the plates 38 in the midstream section. The fins 30 help direct the air flow from the orifices 44 forwardly from the midstream section to the downstream section.

The blower 32 may be operated to move air through the rear opening to be initially cooled by evaporating water from the plates 38. The air is then moved through the orifices 44 to the midstream section and into the downstream section, where it may be further cooled by evaporating water from the tubes 22. According to a first exemplary embodiment, superheated refrigerant enters the tubes 22 and condenses into a liquid by rejecting heat to the cool airstream.

Figure 2:
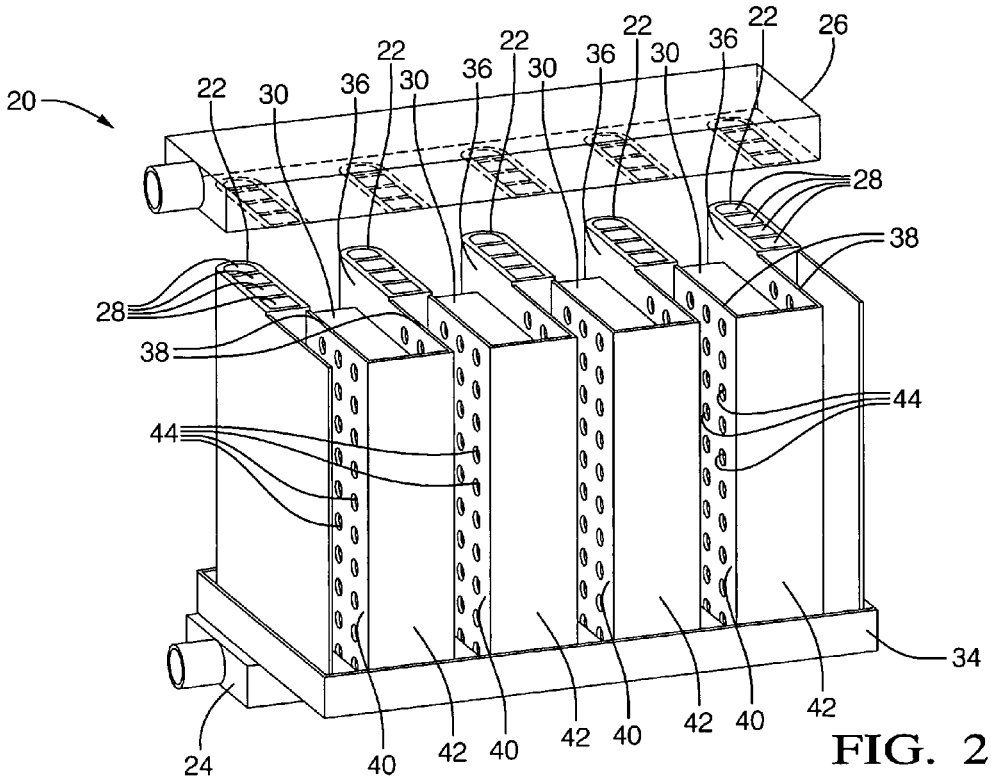
FIG. 2 is a rear perspective view of the heat exchanger in accordance with the first embodiment.
Figure 3:
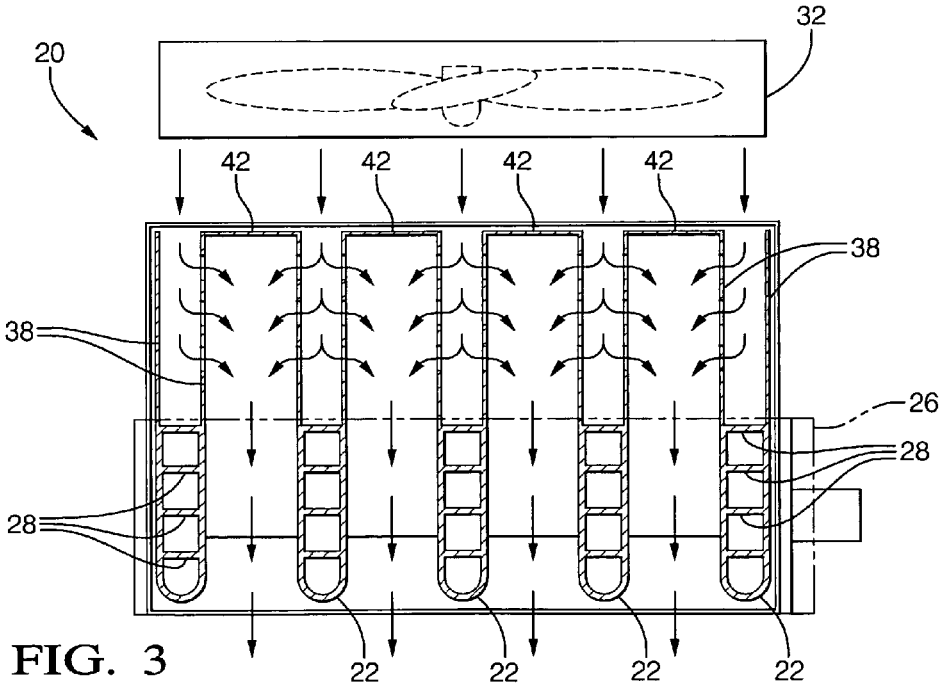
FIG. 3 is a top view of the heat exchanger in accordance with the first embodiment.
Figure 4:
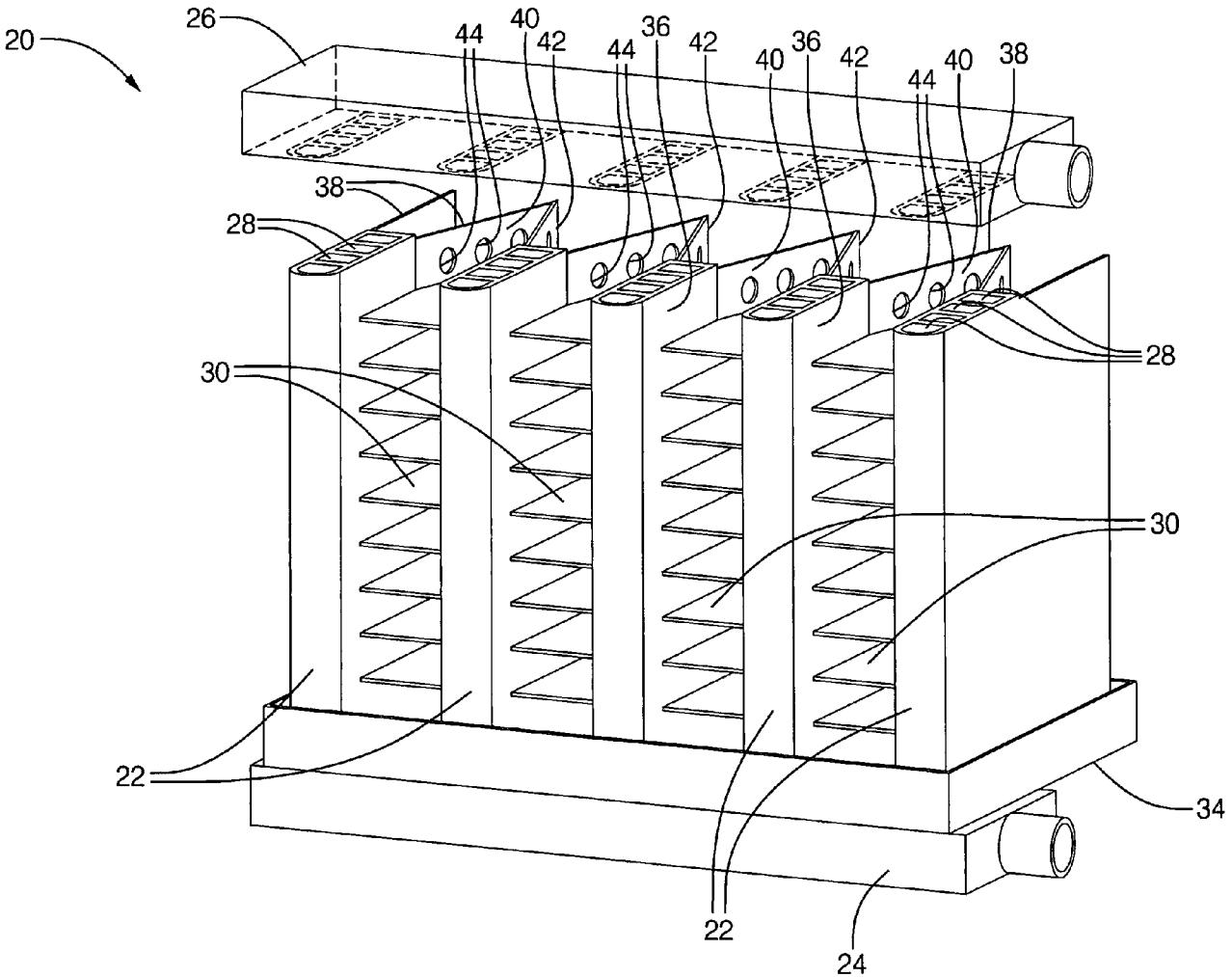
FIG. 4 is a front perspective view of a heat exchanger in accordance with a second embodiment of the present invention.
Figure 5:
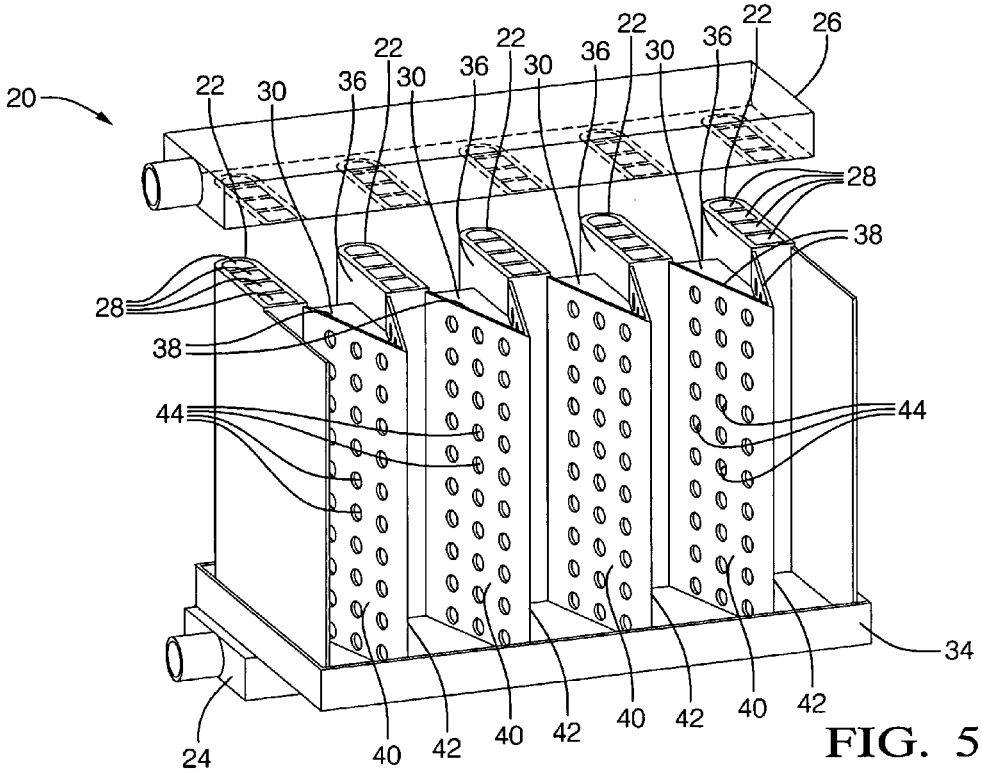
FIG. 5 is a rear perspective view of the heat exchanger in accordance with the second embodiment.
Figure 6:
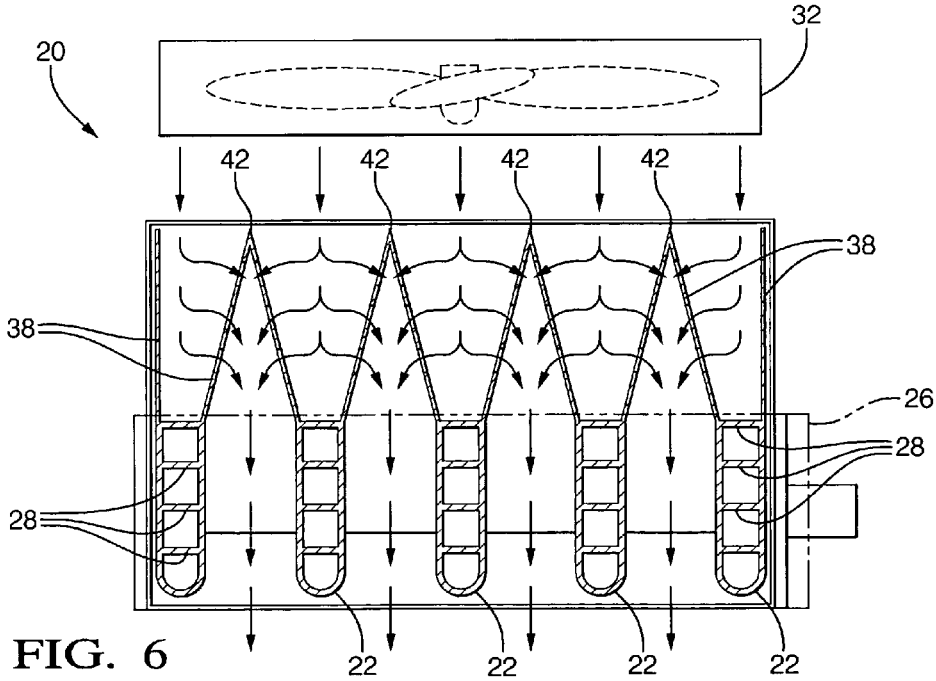
FIG. 6 is a top view of the heat exchanger in accordance with the second embodiment.

As shown specifically in FIGS. 1-3, the connector 42 is a connector panel 42 extending transversely to the plates 38 and connecting the distal edges of the plates 38. According to a second exemplary embodiment, shown specifically in FIGS. 4-6, the plates 38 extend from adjacent tubes 22 and converge toward one another to an apex. The connector 42 connects the distal edges at the apex.

Figure 7:
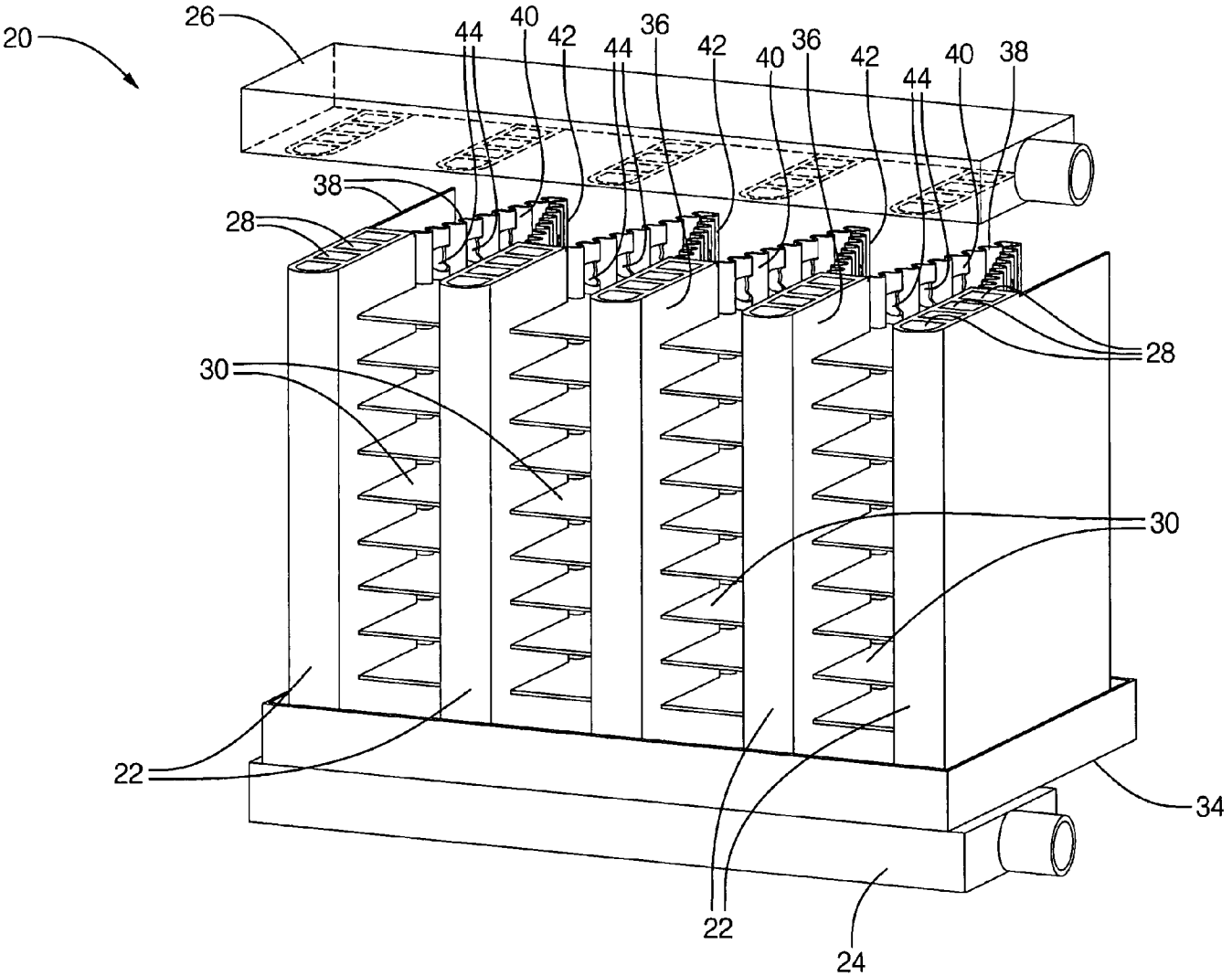
FIG. 7 is a front perspective view of a heat exchanger in accordance with a third embodiment of the present invention.
Figure 8:
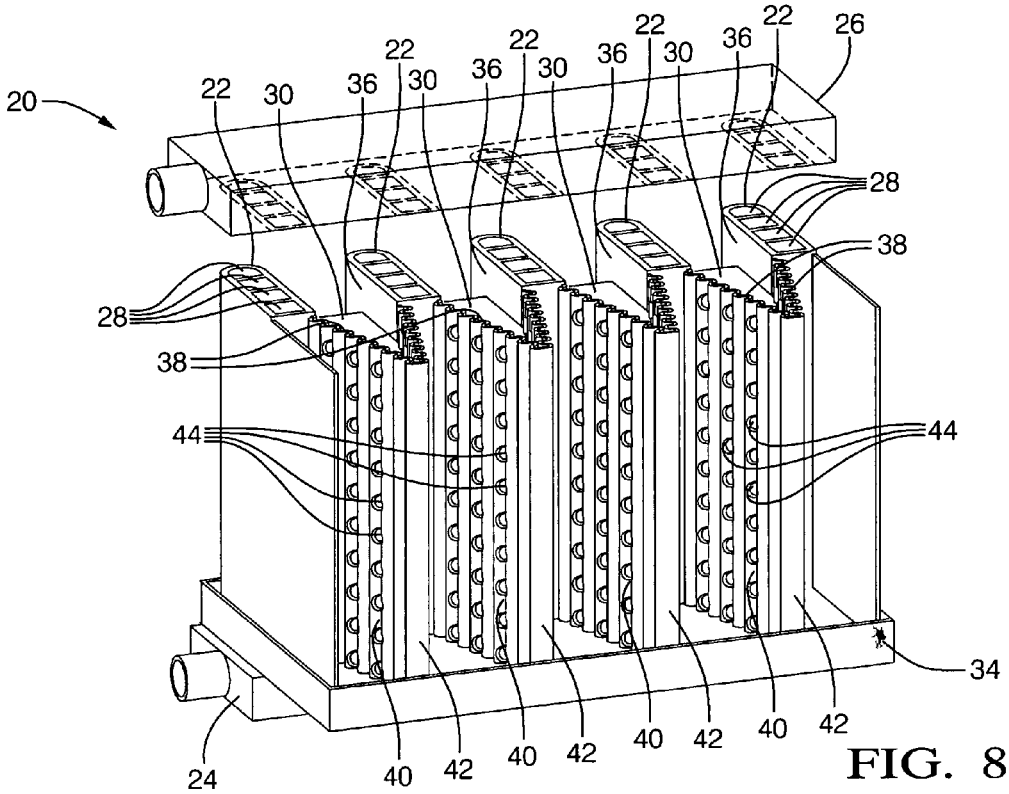
FIG. 8 is a rear perspective view of the heat exchanger in accordance with the third embodiment.
Figure 9:
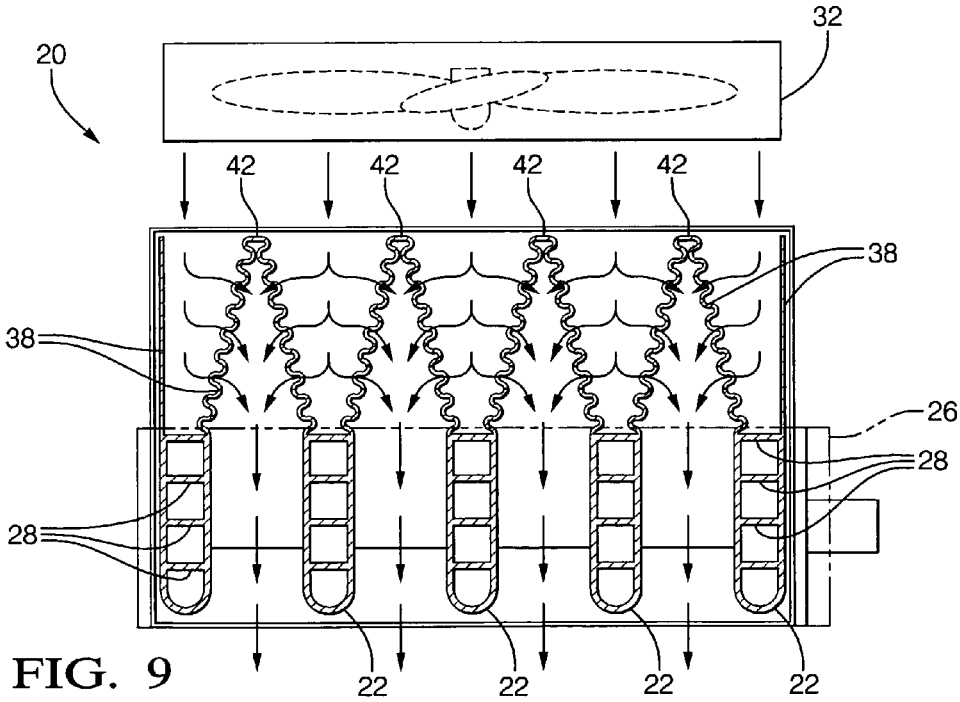
FIG. 9 is a top view of the heat exchanger in accordance with the third embodiment.

According to a third exemplary embodiment, shown specifically in FIGS. 7-9, the plates 38 are corrugated to increase the available surface area and to increase the cooling effect. The plates 38 of the present embodiment have a continuous "S" shape as viewed in cross section extending laterally substantially the entire width of the plates 38.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for conditioning air comprising;

at least a pair of condensing tubes spaced apart from one another and extend longitudinally from a lower end to an upper end to define a downstream section therebetween, wherein each of said condensing tubes includes passages for refrigerant flow and an exterior surface, a bottom header in fluid communication with said passages at said lower end of said condensing tubes, a top header in fluid communication with said passages at said upper end of said condensing tubes, a pair of plates extending longitudinally from the lower end to the upper end and projecting outwardly from each of said condensing tubes to a distal edge to define a midstream section therebetween axially aligned with and in fluid communication with said downstream section, a water tank surrounding said lower end of said condensing tubes and lower end of said plate, and a wicking material extending from said water tank and lining said exterior surfaces of said condensing tubes and said plate for moving water by capillary action from said water tank to said exterior surfaces of said condensing tubes and plate wherein said pair of plates include a plurality of orifices for receiving and distributing air flow into said midstream section and a connector connecting said distal edges of said plates projecting from adjacent tubes to define a closed portion of said midstream section between said pair of condensing tubes.

2. The assembly as set forth in claim 1 further including a blower to move air over said plate and over said tube.

3. The assembly as set forth in claim 1 wherein said plates are parallel to one another.

4. The assembly as set forth in claim 1 wherein each of said plates includes at least one corrugation extending longitudinally therealong in an "S" shape as viewed in cross section.

5. The assembly as set forth in claim 4 wherein said plates further comprise corrugated plates having a continuous "S" shape corrugation extending longitudinally therealong as viewed in cross section and extending laterally substantially the entire width of said plates.

* * * * *